United States Patent [19]

Proehl

[11] 4,050,170

[45] Sept. 27, 1977

[54] DREDGE CUTTER HEAD

[75] Inventor: Norman P. Proehl, Lake Forest, Ill.

[73] Assignee: Norman P. Proehl, Lake Forest, Ill.

[21] Appl. No.: 658,245

[22] Filed: Feb. 17, 1976

[51] Int. Cl.[2] ..... E02F 3/92

[52] U.S. Cl. ..... 37/67; 37/141 T; 175/410; 175/411

[58] Field of Search ..... 37/67, 64–66, 37/189, 141 R, 141 T, 142 R, 70; 175/410, 411, 409; 299/91, 93, 89, 90

[56] References Cited

U.S. PATENT DOCUMENTS

| | | | |
|---|---|---|---|
| 709,861 | 9/1902 | Bates | 37/67 |
| 719,567 | 2/1903 | Conlin | 37/70 |
| 977,955 | 12/1910 | Karns | 299/91 X |
| 1,246,990 | 11/1917 | Ohlhausen | 37/67 |
| 1,436,015 | 11/1922 | Cushing | 37/67 |
| 1,775,984 | 9/1930 | Younie | 37/141 T |
| 2,029,816 | 2/1936 | Ewing | 37/67 |
| 2,665,893 | 1/1954 | Ball | 299/93 X |
| 2,702,951 | 3/1955 | Talboys | 37/104X |
| 2,979,838 | 4/1961 | Raymond et al. | 37/141 R X |
| 3,101,933 | 8/1963 | Krekeler | 299/93 |
| 3,419,976 | 1/1969 | Reising | 299/91 X |
| 3,760,518 | 9/1973 | Hamm | 37/67 X |
| 3,766,354 | 10/1973 | Bierwith | 37/142 R UX |
| 3,805,423 | 4/1974 | Engel et al. | 175/410 X |
| 3,807,066 | 4/1974 | Proehl | 37/67 |
| 3,913,979 | 10/1975 | Strauss et al. | 37/191 A X |

*Primary Examiner*—Clifford D. Crowder
*Attorney, Agent, or Firm*—Kinzer, Plyer, Dorn & McEachran

[57] ABSTRACT

A cutter head for a suction dredge which is constructed of simplified wearing parts and strength members which may be easily assembled and replaced. The cutter includes a circular front plate mounted on a hub. Portions of the circular front plate are cut away to form a plurality of spokes extending radially outwardly of the hub. Struts extend between the circular plate and a back ring having a greater radius than the spokes to form a truncated conical cutter head. Blades are connected to the struts and are inclined in the direction of rotation of cutter head. A plurality of inclined lifter plates are attached to the circular front plate on the rear side thereof. Each lifter plate is aligned with and extends rearwardly from a cut away portion of the circular front plate. Scoops are mounted on the front side of the circular front plate and each scoop forms a forward extension of an inclined lifter plate. Cutting tooth assemblies are attached to and are positioned along the struts. The teeth extend radially to the longitudinal axis of the cutter head and project outwardly beyond the blades. Each cutter tooth is positioned in a socket mounted on a strut. Each tooth is held in its socket by a removable fastener extending through aligned openings in the socket and in the tooth. A tooth backup member engages the trailing edge of each tooth to absorb forces exerted against the tooth during digging operations.

8 Claims, 7 Drawing Figures fig.1.
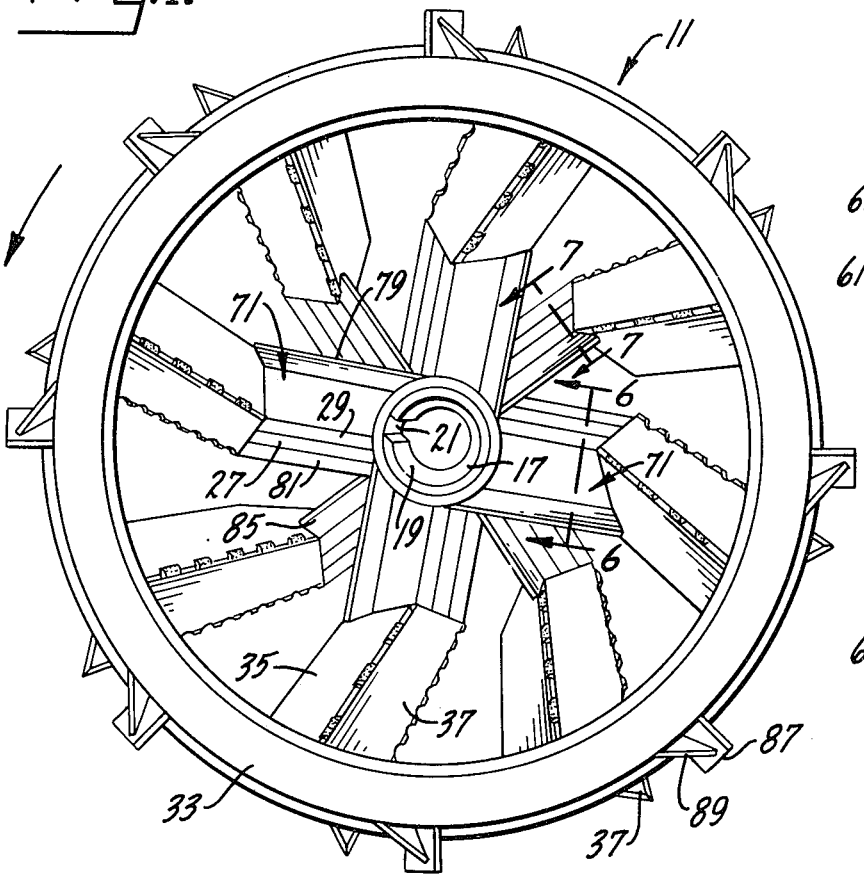
fig.4.
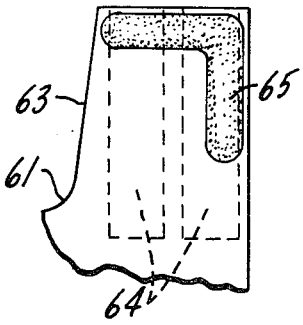
fig.5.
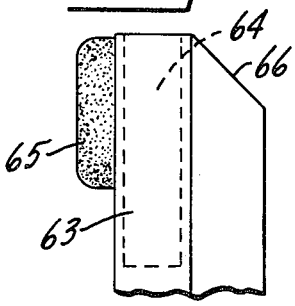
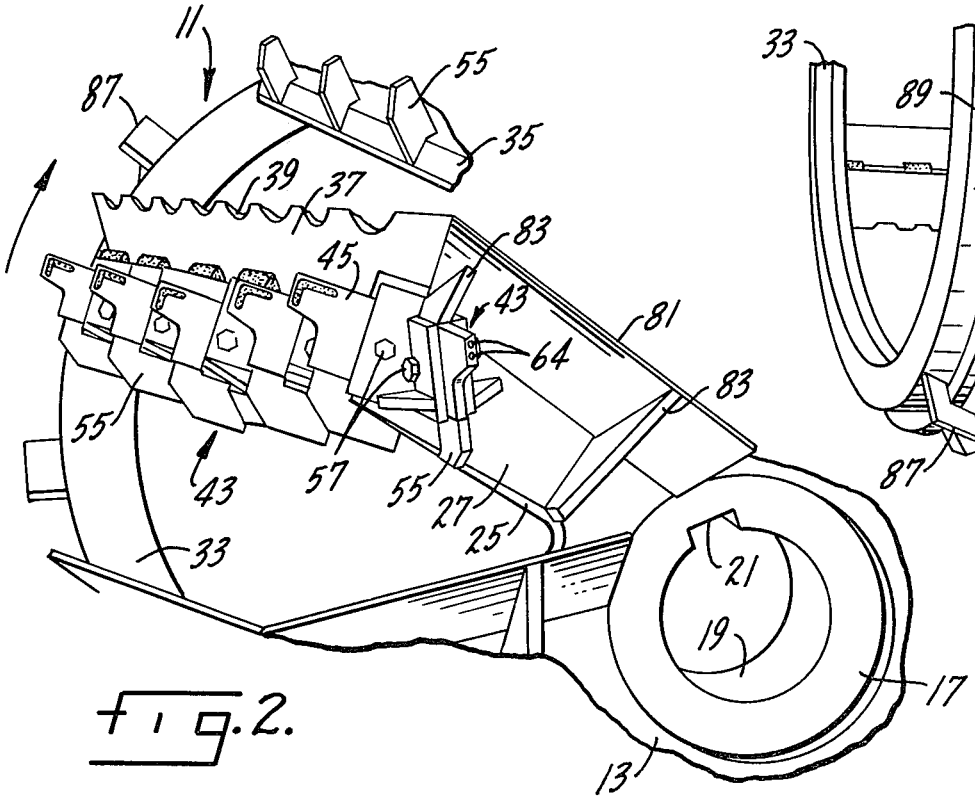
fig.2.
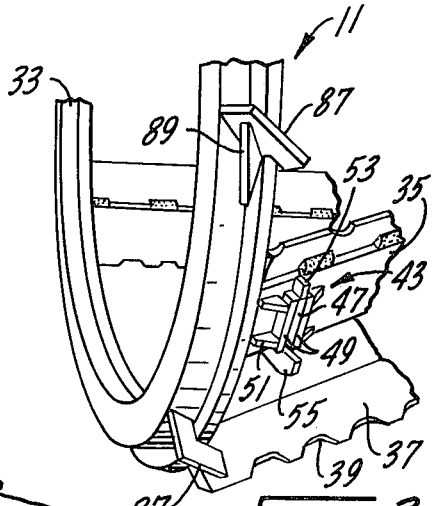
fig.3.

DREDGE CUTTER HEAD

BACKGROUND OF THE INVENTION

The cutter head of this invention is an improvement of the cutter head shown and described in my U.S. Pat. No. 3,807,066, issued Apr. 30, 1974. The improved cutter head utilizes many of the principles and features of the cutter head of my patent. For example, it can be constructed of simplified wearing parts and strength members which may be easily assembled and replaced. Also, practically all of the parts of my improved cutter head can be formed of straight pieces of material of conventional cross-sections such as rectangular or square, which have been cut to fit. In contrast, most of the commercially available cutter heads utilize complex, machined, cast or forged parts which are expensive to manufacture and to repair.

The cutter head of this invention is intended for use on suction dredges used in hydraulic dredging. Hydraulic dredging is a highly competitive business in which extremely large amounts of material must be moved rapidly and at minimum cost in order for a contractor to be successful. For this reason, it is imperative that the cutter head be as efficient as possible in removing material.

SUMMARY OF THE INVENTION

This invention is directed to a cutter head for a suction dredge and more particularly, to a cutter head that has increased digging capacity in comparison with conventional heads, especially in hard-to-dig materials such as coral.

An object of this invention is a cutter head which can be manufactured from readily available materials that do not have to be specially cast, forged or machined.

Another object is a cutter head having both structural and wearing parts which may be easily replaced.

Another object is a cutter head which is capable of high digging volume in hard materials without causing damaging vibrations to the suction dredge.

Another object is a cutter head having easily replaceable digging teeth of hardened material which teeth do not have to be welded to the cutter head.

Another object is a cutter head having easily replaceable cutter teeth with attachment means for the teeth that resist break off even under difficult digging conditions.

Another object is cutter teeth that can be made inexpensively from readily available stock items.

Other objects may be found in the following specification, claims and drawings.

BRIEF DESCRIPTION OF THE DRAWINGS

The invention is illustrted more or less diagrammatically in the following drawings wherein:

FIG. 1 is a perspective view of the rear of a cutter head embodying the novel features of this invention;

FIG. 2 is a partial view of the front of the cutter head of FIG. 1 on a somewhat enlarged scale;

FIG. 3 is a partial perspective view of the back ring portion of the cutter head with a cutting tooth omitted from a tooth socket;

FIG. 4 is an enlarged partial side elevational view of a cutter tooth;

FIG. 5 is an enlarged partial front elevational view of a cutter tooth;

DESCRIPTION OF THE PREFERRED EMBODIMENT

Figure 6:
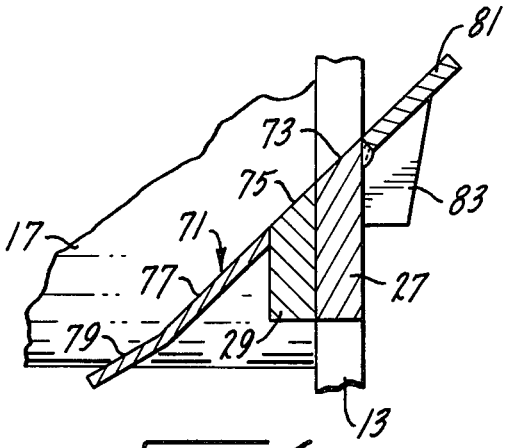
FIG. 6 is an enlarged cross-sectional view taken along line 6—6 of FIG. 1.
Figure 7:
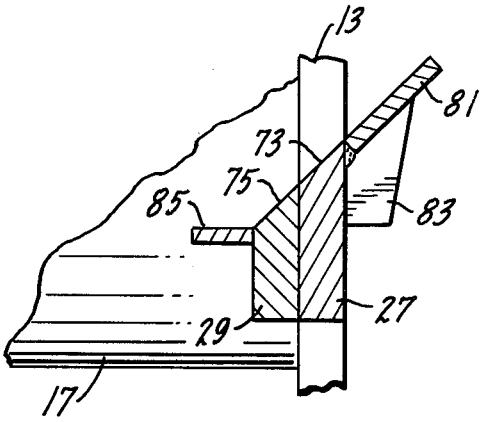
FIG. 7 is an enlarged cross-sectional view taken along line 7—7 of FIG. 1.

A cutter head 11 embodying the novel features of this invention is shown in perspective in FIGS. 1, 2 and 3 of the drawings. This cutter head includes a circular front plate 13 which may be formed of a suitable metal such as a mild steel. A cylindrical hub 17 having a socket 19 which receives a cutter head drive shaft (not shown) extends through and is fastened to the circular front plate 13. A keyway 21 is provided to receive a key (not shown) for securing the drive shaft to the hub of the cutter head. Other types of hubs may also be used. For example, a threaded hub or a tapered hub could be substituted for the keyed hub which is illustrated. Somewhat wedge-shaped, circumferentially spaced portions 25 of the circular front plate 13 are cut away to form radially extending spokes 27 in the front plate. As an alternate form of construction, the spokes 27 could be formed separately and fastened to the hub in any conventional manner, such as by welding. Reinforcing members 29 are welded or otherwise fastened to the rear of the front plate 13 and extend from the hub 17 outwardly along the spokes.

A steel back ring 33 of larger radius than that of the spokes 27 is connected to the front plate 13 by steel struts 35 which are generally rectangular in cross section. Any convenient number of struts may be provided. Eight has been found to be a satisfactory number. The struts are fastened by welding to the outer ends of the spokes 27 and to the outer surface of the base ring 33. The ends of the struts connected to the spokes are positioned to lead the ends of the struts connected to the base ring in the direction of rotation of the cutter head, which is counter clockwise as viewed in FIG. 1. The lead of the struts may be varied in accordance with the diameter and length of the cutter head and also upon the type of material to be dug.

Blades 37, which are straight members of generally rectangular cross-section, are attached to the leading edges of the struts 35 and to the spokes 27 by welding. It is advantageous to form the blades from steel of a better gradethan that used for the struts 35. The blades are inclined in the direction of rotation of the cutter head. The angle of inclination of the blades may be varied depending upon the material being dug. In the embodiment shown, the blades are inclined at an angle of approximately 30° relative to the struts. It should be appreciated that the manner of attachment of the blades to the struts may be varied although welding is preferred. Notches 39 are cut in the leading edges of the blades in order to provide the blades with serrated edges for improved cutting. For the same reason the leading edges of the blades may be bevelled.

Upstanding cutting tooth assemblies 43 are mountedon the struts and spaced apart between the circular front plate 13 and the base ring 33. The number of cutting tooth assemblies mounted on each strut may be varied depending upon the size of the cutter head. In the present embodiment, five cutting tooth assemblies are mounted on each strut. The cutting tooth assemblies on adjacent struts may be staggered to provide an overlap of the cutting teeth.

Each cutting tooth assembly includes a cutting tooth 45 which fits into and is supported in a socket 47 mounted on a strut 35. For clarity of illustration, an empty socket is shown in FIG. 3. Each socket defines a rectangular opening and includes parallel side walls 49 which are preferably welded to the strut and are supported by triangular gussets 51 also welded to the strut. The side walls of the socket extend at right angles to the axis of the cutter head rather than at right angles to the axis of their strut since, as previously mentioned, the forward ends of the struts are tilted to lead in the direction of rotation of the cutter head. Each socket also includes a front wall 53 welded to the strut and a backup member or rear wall 55 which is welded to the strut and extends above the side walls 49 to function as a backup or reinforcement for the tooth.

Fastener openings (not shown) are provided in the side walls 49 of the socket and in the cutting tooth 45. When a tooth is inserted in a socket in the proper manner, as shown in FIG. 2, the fastener openings are aligned and a fastener, such as bolt and nut 57, can be extended through the openings to secure the tooth in the socket. Both the socket members and the teeth are preferably made of a hardened steel such as a Brinnell 380 hardness steel.

Each cutting tooth 45 is shaped from a generally planar piece of steel. The trailing portion of each cutting tooth is removed or cut away at 61 leaving a peak portion 63 at the leading edge thereof. Cylindrical tungsten carbide inserts 64 are cemented in holes drilled in the top edge of the peak portion 63. An inverted L-shaped bead 65 of eutectic carbide steel is applied by welding to the forward face of the peak portion of each cutting tooth. A bead one-fourth inch in height has been found to be satisfactory. The opposite face of the peak portion of each cutting tooth is chamfered at 66 to reduce drag.

Lifter plate assemblies 71, shown in cross-sectional detail in FIG. 6, are mounted on the rear side of the circular front plate 13 on alternate spokes 27. A lifter plate assembly is positioned at the leading edge of each spoke relative to the direction of the rotation of the cutter head. On each spoke, the leading edge of the spoke is bevelled at 73 as is the leading edge 75 of the spoke reinforcing member 29. To form the bevels, the spoke and the spoke reinforcing member are cut on 45° angles. On each spoke having a lifter plate assembly, lifter plate 77 is attached to the spoke reinforcing bar 29 and extends rearwardly of the spoke reinforcing member at the same angle as the bevel. Thus, a continuous path is formed across the spoke, the spoke reinforcing member and the lifter plate. An upturned flap 79 is attached to the end of each lifter plate. A scoop 81 is attached to the circular front plate 13 at the leading edge of each spoke. On the spokes having lifter plates installed, the scoop forms a forward continuation of the lifter plate in the manner shown in FIG. 6. Each scoop extends outwardly from the hub 17 to meet the forward end of a blade 37 to form a generally L-shaped digging member. Braces 83 for the scoops are installed on the trailing sides thereof, as shown in FIGS. 2 and 6. An outer brace 83, shown in FIG. 2, also functions as the front wall of a cutting tooth socket. One or more notches (not shown) may be formed in the leading edge of each scoop. The scoops preferably are made from Brinnell 380 hardness steel. On alternate spokes not having lifter plates, an additional reinforcing member 85 is attached to the rear of reinforcing member 29 and provides some additional lifting effect for the alternate spokes.

A cutting tooth assembly 43 is provided on the circular front plate 13 adjacent the outer end of each spoke 27. Each tooth assembly projects at right angles to the circular front plate 13 and are inclined at an angle of 45° tangentially to the direction of rotation of the cutter head. The peaks of the teeth extend axially forward of the scoops 81.

Scraper plates 87 are attached to the cutter head back ring 33 with one scraper plate positioned in front of each blade 37. The plates project radially of the ring and are tilted at 45° to the longitudinal axis of the cutter head. Each scraper plate has a support 89 welded to the back ring.

The use, operation and function of this invention are as follows:

The cutter head shown and described herein is an improvement over the cutter head shown and described in my U.S. Pat., No. 3,807,066, issued Apr. 30, 1974. The improvements increase the capacity of the cutter head in digging hard, abrasive materials such as coral. Of course, it should be understood that these improvements will also enable the cutter head to achieve higher digging capacity in other hard, abrasive materials. To obtain the increased digging capacity of my cutter head, I have provided openings in the circular front plate 13 which allow material to be moved through this plate as well as between the cutter blades 37 to the lifter plate means. These openings are in the form of circumferentially spaced, cutaway portions 25 which form spokes 27 in the circular front plate. In order to supply material to be moved through the cut-away portions in the circular front plate, cutter tooth assemblies 43 are installed on the forward face of the circular front plate 13 and scoops are positioned adjacent each cut-away portion. At alternate cut-away portions, the scoops lead into lifter plate assemblies 71 which assist in moving the cut material through the cutter head to the suction opening of the dredge suction pipe which is conventional and is not shown.

In order to reduce damaging vibrations when digging hard, compact material such as coral, the struts 35 and the cutter blades 37 attached to the struts are canted so that the forward ends thereof lead their trailing ends in the direction of rotation of the cutter head. It has also been found advantageous to serrate the leading edge of the blades 37 by forming notches 39 therein.

The cutting tooth assemblies 43 of my improved cutter head are easily replaceable yet resist breakage and pullout even during difficult digging operations. Installation and removal of a tooth can be accomplished by the manipulation of a single threaded fastener 57 for each tooth assembly. Thus, the need to weld teeth to the struts and to cut or burn them loose after they have worn, has been eliminated.

Pullout and breakage of the teeth is also reduced by the provision of backup members or rear walls 55 which engage the trailing edges of the teeth and support them in the sockets. The cost of my teeth is less than that of commercially available basket type pick point or chisel teeth since they are made of stock pieces of hardened steel. Wear resistance is increased by the provision of a welded-on cutting bead 65 which is formed of a eutectic carbide steel. Thus, the cutter teeth can easily be manufactured at the dredging site.

Whereas, the preferred form of my invention has been described and shown, it should be understood that there are modifications, alterations and changes which may be made to the cutter head without departing from my teachings. Therefore, the scope of my invention should be limited only by a liberal interpretation of the claims annexed hereto.

I claim:

1. A cutter head for a suction dredge, including: a hub, a plurality of generally radially extending spokes of substantially equal lengths mounted on said hub, a back ring of greater radius than said spokes, struts extending between said spokes and said back ring with said struts connected to said spokes at the outer ends thereof and to the back ring near the periphery thereof to form a truncated conical structure, blades mounted on said struts and inclined in the direction of rotation of said cutter head, and radially extending forwardly projecting scoop plates mounted on said spokes at the leading edges thereof with said scoop plates being inclined in the direction of rotation of said cutter head, the radially outer ends of said scoop plates abutting and connecting with the forward ends of said strut blades to form generally L-shaped digging members.

2. The cutter head of claim 1 in which inclined lifter plates are mounted on at least some spokes on the back ring side thereof and inside said strut blades with each lifter plate located at the leading edge of a spoke and forming a rearwardly continuation of the forwardly projecting scoop plate mounted on the spoke.

3. The cutter head of claim 2 in which said inclined lifter plates are mounted on alternate spokes.

4. The cutter head of claim 1 in which the forward ends of said struts lead the rearward ends of the struts in the direction of rotation of said cutter head.

5. The cutter head of claim 1 in which cutting tooth assemblies are attached to said struts and are positioned along the lengths thereof with the teeth of said tooth assemblies extending radially and projecting outwardly beyond said blades of said struts.

6. The cutter head of claim 5 in which each cutting tooth assembly includes a cutting tooth, a socket which receives said tooth and is mounted on a strut, fastener openings in said socket and said tooth which openings align when said tooth is positioned in said socket, a removable fastener which extends through said aligned openings to secure said tooth to said socket, and a tooth back-up member which engages the trailing edge of said tooth projecting above said socket to absorb forces which are exerted against said tooth during digging operations.

7. The cutter head of claim 6 in which said cutting tooth is upstanding in said socket, said tooth has a peaked portion at its leading edge and a hardened cutting layer applied to the forward facing side of said tooth portion.

8. The cutter head of claim 7 in which hardened inserts are provided in said peaked portion.

* * * * *